US009151041B2

(12) United States Patent
Lee

(10) Patent No.: US 9,151,041 B2
(45) Date of Patent: Oct. 6, 2015

(54) SOUNDPROOF PANEL CONNECTION STRUCTURE

(71) Applicant: LOFA Corporation, Ulsan (KR)

(72) Inventor: Byung Guk Lee, Ulsan (KR)

(73) Assignee: LOFA Corporation, Ulsan (KR)

( * ) Notice: Subject to any disclaimer, the term of this patent is extended or adjusted under 35 U.S.C. 154(b) by 0 days.

(21) Appl. No.: 14/451,897

(22) Filed: Aug. 5, 2014

(65) Prior Publication Data

US 2015/0041249 A1 Feb. 12, 2015

(30) Foreign Application Priority Data

Aug. 6, 2013 (KR) ..... 10-2013-0092992

(51) Int. Cl.
*E04B 1/84* (2006.01)
*E04B 1/82* (2006.01)

(52) U.S. Cl.
CPC ..... *E04B 1/8409* (2013.01); *E04B 1/8218* (2013.01); *E04B 2001/8263* (2013.01); *E04B 2001/8452* (2013.01)

(58) Field of Classification Search
CPC .. E04B 1/8409; E04B 2001/8263; E01F 8/00; E01F 8/0005; E01F 8/0011; E01F 8/0017
USPC ..... 181/210, 294; 52/144, 145
See application file for complete search history.

(56) References Cited

U.S. PATENT DOCUMENTS 4,143,495 A * 3/1979 Hintz ..... 52/145
5,426,267 A * 6/1995 Underhill et al. ..... 181/210
6,314,687 B1 * 11/2001 Schondelmayer et al. ..... 52/63
6,899,200 B1 * 5/2005 Roberts et al. ..... 181/285

(Continued)

FOREIGN PATENT DOCUMENTS

KR 1020050065766 A 6/2005
KR 10-2009-0012025 A 2/2009
KR 10-0918422 B1 9/2009

(Continued)

OTHER PUBLICATIONS

International Search Report for the corresponding International Patent Application No. PCT/KR2014/006976 filed Jul. 30, 2014, issued Sep. 29, 2014.
Written Opinion for the corresponding International Patent Application No. PCT/KR2014/006976 filed Jul. 30, 2014, issued Sep. 29, 2014.

*Primary Examiner* — Jeremy Luks
(74) *Attorney, Agent, or Firm* — Westman, Champlin & Koehler, P.A.; Z. Peter Sawicki; Amanda Prose

(57) ABSTRACT

A soundproof panel connection structure including: a plurality of posts spaced apart from each other on the floor by a given distance; a plurality of soundproof panels each located between the neighboring posts and having fastening portions disposed on both end portions thereof; bending portions each extended from one side surface of each soundproof panel; soundproof materials each interposed between each fastening portion and each bending portion in such a manner as to be supportedly brought on one surface thereof into contact with one side surface of each post; and a plurality of connection joints each coupled on both ends thereof to the fastening portions disposed on both side surfaces of each post, wherein the post located at the corner portion in the plurality of posts has supports located at the outer surfaces thereof.

5 Claims, 3 Drawing Sheets

(56) References Cited

U.S. PATENT DOCUMENTS

| | | | | |
|---|---|---|---|---|
| 2013/0025217 | A1* | 1/2013 | Corbin, Jr. | 52/144 |
| 2013/0092473 | A1* | 4/2013 | Humphries et al. | 181/285 |

FOREIGN PATENT DOCUMENTS

| | | | |
|---|---|---|---|
| KR | 10-1023524 | B1 | 3/2011 |
| KR | 10-1119976 | B1 | 3/2012 |

* cited by examiner

SOUNDPROOF PANEL CONNECTION STRUCTURE

CROSS-REFERENCE TO RELATED APPLICATION

This application is based on and claims priority from Korean Patent Application No. 10-2013-0092992 filed on Aug. 6, 2013 in the Korean Intellectual Property Office, the disclosure of which is incorporated herein in its entirety by reference.

BACKGROUND OF THE INVENTION

1. Field of the Invention

The present invention relates to a soundproof panel connection structure, and more particularly, to a soundproof panel connection structure that is installed on a press line or part production line to block the sound generated from the press line or part production line.

2. Background of the Related Art

Generally, soundproof panels are installed to absorb and block the sound generated from industrial sites, that is, from a press line or part production line.

The soundproof panels serve as a sound reduction structure that absorbs and blocks sound in the process of transmitting the sound to allow the sound transmitted to the surrounding area to be reduced to a given reference value.

As shown in FIGS. 1*a* and 1*b*, according to a conventional soundproof panel connection structure installed on a press line or part production line, soundproof panels 10 are coupled to each other by means of welding, and otherwise, they are installed on both side surfaces of an I-shaped frame 20.

Firstly, the soundproof panel connection structure through the welding undesirably needs lots of time and labor forces in removing the soundproof panels 10 if the press line or part production line is expanded, the layout is changed, or the whole equipment is discharged to the outside to repair the equipment disposed inside the soundproof panels 10.

If the soundproof panels 10 are reassembled after the completion of the equipment repairing, further, it is impossible to return them to their original state, and even if returned, the connection structure is not clean on the outer appearance thereof. On the other hand, if the flatness on the floor surface at which the soundproof panels 10 are located is not uniform, it is hard to assemble the soundproof panels 10 with each other.

Secondly, the soundproof panel connection structure, wherein the soundproof panels 10 are located on both side surfaces of the I-shaped frame 20, transmits the vibration value transmitted to the I-shaped frame 20 underneath the soundproof panels 10, thus increasing the vibration noise, and further, the soundproof panels 10 are not brought accurately into close contact with the I-shaped frame 20, thus making the sound emitted to the outside through the gap generated between the soundproof panels 10 and the I-shaped frame 20 to reduce the soundproof effect.

SUMMARY OF THE INVENTION

Accordingly, the present invention has been made in view of the above-mentioned problems occurring in the prior art, and it is an object of the present invention to provide a soundproof panel connection structure that can easily remove and rebuilt soundproof panels if a press line or part production line is expanded, the layout is changed, or the whole equipment is discharged to the outside to repair the equipment disposed inside the soundproof panels, and that can easily assemble the soundproof panels even in case where the flatness on the floor surface at which the soundproof panels are located is not uniform.

It is another object of the present invention to provide a soundproof panel connection structure that can prevent the deformation of soundproof panels upon their coupling and separation, thus reducing the coupling errors of the soundproof panels to extend their life term.

It is still another object of the present invention to provide a soundproof panel connection structure that can prevent the emission of sound to the outside through the connection portion between the soundproof panels, thus avoiding the reduction of the soundproof effect.

To accomplish the above objects, according to the present invention, there is provided a soundproof panel connection structure including: a plurality of posts spaced apart from each other on the floor by a given distance; a plurality of soundproof panels each located between the neighboring posts and having fastening portions disposed on both end portions thereof; bending portions each extended from one side surface of each soundproof panel; soundproof materials each interposed between each fastening portion and each bending portion in such a manner as to be supportedly brought on one surface thereof into contact with one side surface of each post; and a plurality of connection joints each coupled on both ends thereof to the fastening portions disposed on both side surfaces of each post, wherein the post located at the corner portion in the plurality of posts has supports located at the outer surfaces thereof in such a manner as to be supportedly brought into contact with one surface of the soundproof material, and the connection joint coupled on both ends thereof to the fastening portions disposed on both side surfaces of the post located at the corner portion is mounted on the outer surface thereof along the corner portion of the post located at the corner portion, whereas the connection joint coupled on both ends thereof to the fastening portions disposed on both side surfaces of the entire post except the post located at the corner portion is mounted along the outer surface of the entire post except the post located at the corner portion.

According to the present invention, desirably, each soundproof material is made of EPDM (Ethylene Propylene Diene Monomer).

According to the present invention, desirably, the connection joints are spaced apart from each other by a given distance along the direction of the height of the plurality of posts, each connection joint being coupled on both ends thereof to the fastening portions disposed on both side surfaces of each post.

According to the present invention, desirably, so as to install a roof along the top portions of the soundproof panels, a 'ㄴ'-shaped fastener is coupled to the upper portion of the corner of the post located at the corner portion and a 'ㄷ'-shaped fastener is coupled to the upper portion of the entire post except the post located at the corner portion.

According to the present invention, desirably, the 'ㄴ'-shaped fastener is coupled to fastening nuts coupled to both side surfaces of the upper portion of the corner of the post located at the corner portion, and the 'ㄷ'-shaped fastener is coupled to fastening holes formed on the upper portion of the entire post except the post located at the corner portion.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
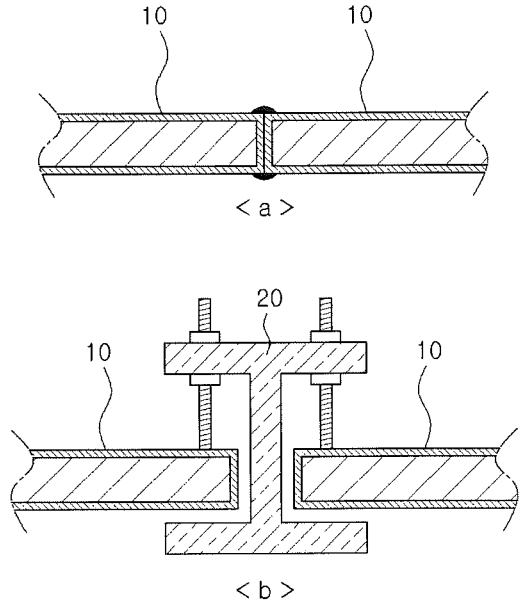
FIGS. 1*a* and 1*b* are sectional views showing a conventional soundproof panel connection structure.

Hereinafter, an explanation on a soundproof panel connection structure according to the present invention will be in detail given with reference to the attached drawing. In the description, the thicknesses of the lines or the sizes of the components shown in the drawing may be magnified for the clarity and convenience of the description.

Further, the terms as will be discussed later are defined in accordance with the functions of the present invention, but may be varied under the intention or regulation of a user or operator. Therefore, they should be defined on the basis of the whole scope of the present invention.

Figure 2:
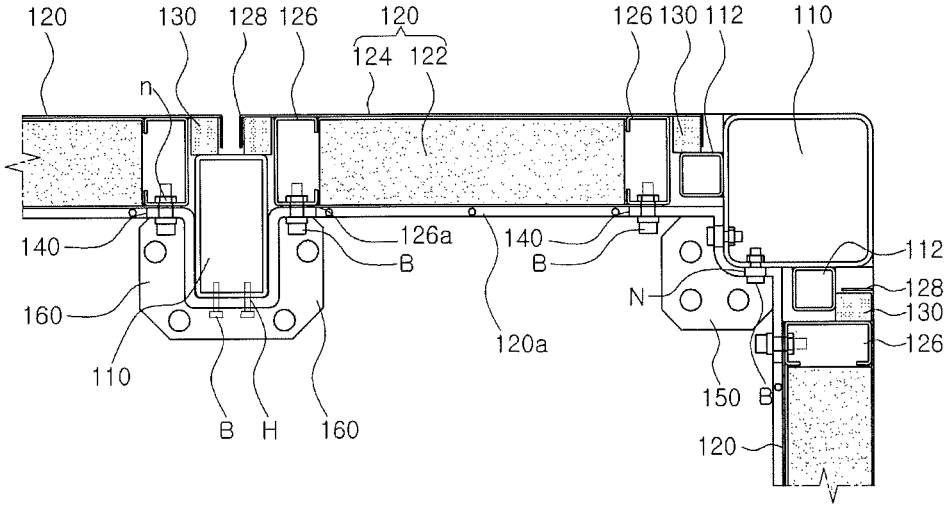
FIG. 2 is a sectional view showing a soundproof panel connection structure according to a first embodiment of the present invention.
Figure 3:
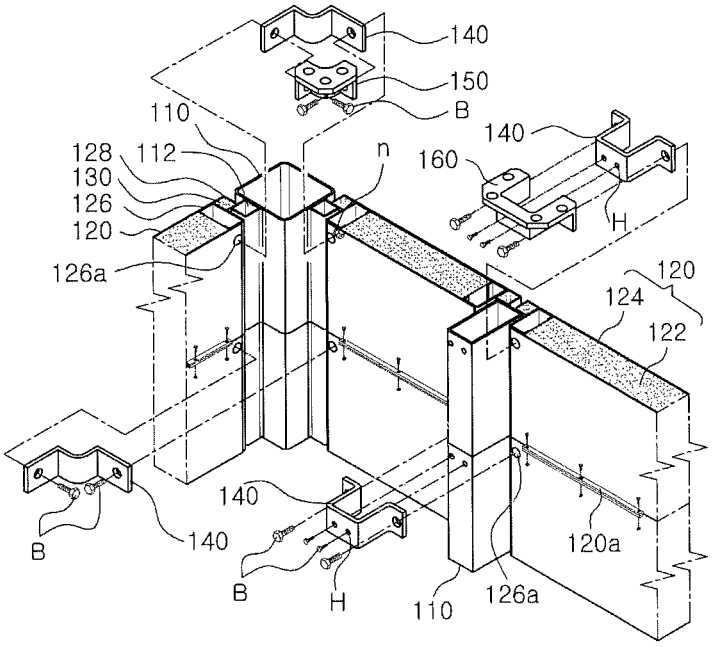
FIG. 3 is an exploded perspective view showing the soundproof panel connection structure according to the first embodiment of the present invention.
Figure 4:
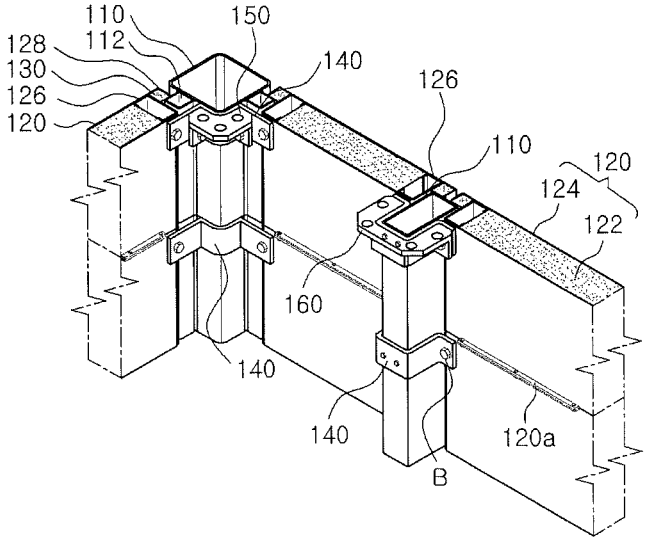
FIG. 4 is a plan view showing the soundproof panel connection structure according to the first embodiment of the present invention.
Figure 5:
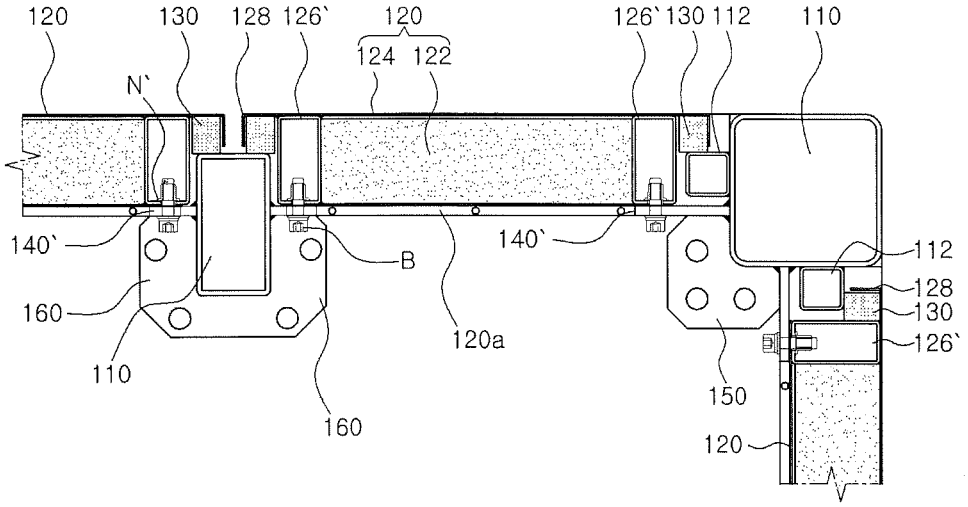
FIG. 5 is an exploded perspective view showing a soundproof panel connection structure according to a second embodiment of the present invention.
Figure 6:
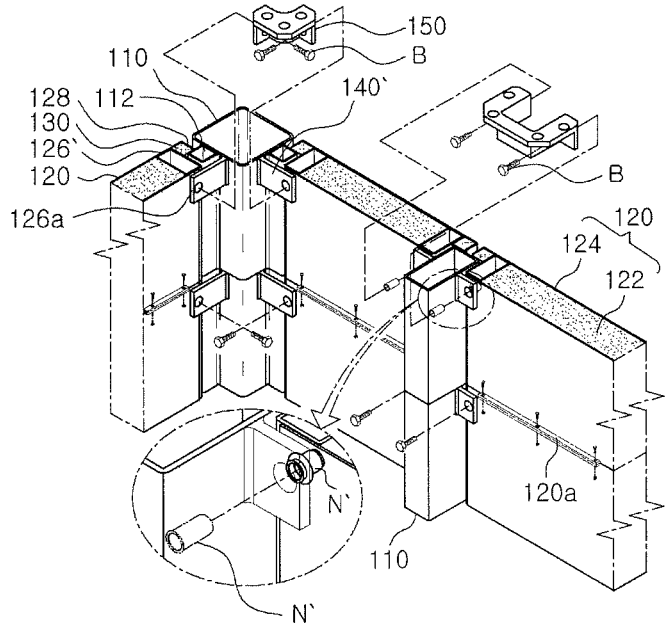
FIG. 6 is a plan view showing the soundproof panel connection structure according to the second embodiment of the present invention.

FIG. 2 is a sectional view showing a soundproof panel connection structure according to a first embodiment of the present invention, FIG. 3 is an exploded perspective view showing the soundproof panel connection structure according to the first embodiment of the present invention, FIG. 4 is a plan view showing the soundproof panel connection structure according to the first embodiment of the present invention, FIG. 5 is an exploded perspective view showing a soundproof panel connection structure according to a second embodiment of the present invention, and FIG. 6 is a plan view showing the soundproof panel connection structure according to the second embodiment of the present invention.

Referring to FIGS. 2 to 4, a soundproof panel connection structure according to a first embodiment of the present invention largely includes a plurality of posts 110, a plurality of soundproof panels 120, bending portions 128, soundproof materials 130, and connection joints 140.

The plurality of posts 110 is spaced apart from each other on the floor by a given distance along the edge of a press line or part production line.

Moreover, supports 112 are located at the outer surfaces of the post 110 located at the corner portion of the edge of the press line or the part production line in such a manner as to be supportingly brought into contact with one surface of each soundproof material 130 as will be discussed later.

Each soundproof panel 120 is located between the neighboring posts 110 and has fastening portions 126 disposed on both end portions thereof. The soundproof panel 120 includes a sound absorbing material 122 and panels 124 coupled to both side surfaces of the sound absorbing material 122.

Further, the plurality of soundproof panels 120 is laminated on top of each other along the direction of the height of the plurality of posts 110, and at this time, the plurality of soundproof panels 120 laminated on top of each other has coupling portions 120*a* disposed on the top and underside thereof.

Each bending portion 128 is extended from one side surface of each soundproof panel 120, that is, any one of the panels 124 coupled to both side surfaces of the sound absorbing material 122.

Each soundproof material 130 is interposed between each fastening portion 126 and each bending portion 128 in such a manner as to be supportedly brought on one surface thereof into contact with one side surface of each post 110, thus preventing the emission of sound to the outside through a fine gap generated between the soundproof panel 120 and the post 110 adjacent to each other.

The soundproof material 130 is desirably made of EPDM (Ethylene Propylene Diene Monomer).

The plurality of connection joints 140 serves to connect the plurality of soundproof panels 120 with each other, and each connection joint 140 is coupled on both ends thereof to fastening holes 126*a* formed on the fastening portions 126 disposed on the end portions of the soundproof panels 120 disposed on both side surfaces of each post 110 by means of bolts B.

The connection joint 140 coupled on both ends thereof to the fastening holes 126*a* formed on the fastening portions 126 disposed on the end portions of the soundproof panels 120 disposed on both side surfaces of each post 110 located at the corner portion is mounted on the outer surface thereof along the corner portion of the post 110 located at the corner portion, and contrarily, the connection joint 140 coupled on both ends thereof to the fastening holes 126*a* formed on the fastening portions 126 disposed on the end portions of the soundproof panels 120 disposed on both side surfaces of the entire post 110 except the post 110 located at the corner portion, is mounted along the outer surface of the entire post 110 except the post 110 located at the corner portion.

Moreover, the connection joints 140 are spaced apart from each other by a given distance along the direction of the height of the plurality of posts 110, and each connection joint 140 is coupled on both ends thereof to the fastening holes 126*a* formed on the fastening portions 126 disposed on the end portions of the soundproof panels 120 disposed on both side surfaces of each post 110.

Further, a plurality of fastening holes 126*a* or a generally rectangular fastening hole 126*a* may be formed on the fastening portions 126 disposed on the end portions of the soundproof panels 120, and in case where the flatness of the floor surface at which the soundproof panels 120 are located is low, the formation of the plurality of fastening holes 126*a* or the generally rectangular fastening hole 126*a* enables the soundproof panels 120 to be flexibly located at the floor surface in accordance with the flatness of the floor surface.

So as to install a roof (not shown) along the top portions of the soundproof panels 120, on the other hand, a 'ㄴ'-shaped fastener 150 is coupled to the upper portion of the corner of the post 110 located at the corner portion, and a 'ㄷ'-shaped fastener 160 is coupled to the upper portion of the entire post. 110 except the post 110 located at the corner portion.

At this time, the 'ㄴ'-shaped fastener 150 is coupled to fastening nuts N coupled to both side surfaces of the upper portion of the corner of the post 110 located at the corner portion by means of bolts B, and the 'ㄷ'-shaped fastener 160 is coupled to fastening holes H formed on the upper portion of the entire post 110 except the post 110 located at the corner portion by means of bolts B.

Referring to FIGS. 5 and 6, the bolts B used to connect the plurality of soundproof panels 120 are fastened by blind rivet nuts N'.

This is because it is difficult to fix the nuts n disposed on the fastening portions 126 to fasten the bolts B and further the soundproof panels 120 are deformedly wrinkled or torn off upon the formation of the fastening holes 126*a* into which the bolts B are inserted and fastened thereon. Accordingly, the introduction of the blind rivet nuts N' enables relatively hard manufacturing processes to be efficiently reduced.

The assembly of the plurality of soundproof panels 120 through the blind rivet nuts N' is carried out through connection joints 140' welded in advance to the side surfaces of the plurality of posts 110 to which the 'ㄴ'-shaped fasteners 150 and the 'ㄷ'-shaped fasteners 160 are coupled in a direction parallel to the plurality of soundproof panels 120 and 'ㅁ'-shaped fastening portions 126' located at the corresponding positions to the connection joints 140', wherein each 'ㄴ'-shaped fastener 150 is located to correspond to the connection joint 140' at the upper portion of the corner of the post 110 located at the corner portion and each 'ㄷ'-shaped fastener 160 is located to correspond to the connection joint 140' at the upper portion of the entire post 110 except the post 110 located at the corner portion, and next, the blind rivet nuts N' are insertedly fixed to the fastening portions 126' and fastened by means of the bolts B.

The formation of the 'ㅁ'-shaped fastening portions 126' enables the blind rivet nuts N' to easily resist the load applied upon the insertion thereof and further allows the coupled soundproof panels 120 to be more rigidly supportedly connected with each other upon the coupling or separation of the soundproof panels 120.

As mentioned above, the soundproof panel connection structure according to the present invention can easily remove and rebuilt the soundproof panels if the press line or the part production line is expanded, the layout is changed, or the whole equipment is discharged to the outside to repair the equipment disposed inside the soundproof panels, and can easily assemble the soundproof panels even in case where the flatness on the floor surface at which the soundproof panels are located is not uniform.

According to the present invention, additionally, each soundproof panel and each post are separated from each other by means of the soundproof material made of a cushion material, so that the vibration value generated inside the post is not connected to the soundproof panel, and the generated sound and vibration are not emitted to the outside through the connection portion between the soundproof panel and the post, thus increasing the soundproof effect of the soundproof panel.

According to the present invention, further, the deformation of the soundproof panels can be prevented upon the coupling and separation of the soundproof panels, thus reducing the coupling errors of the soundproof panels to extend their life term.

According to the present invention, additionally, the soundproof panels can be built in a relatively simple structure, thus decreasing the number of processes and reducing the material costs and the personnel costs.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A soundproof panel connection structure comprising:

a plurality of posts spaced apart from each other on the floor by a given distance;

a plurality of soundproof panels each located between the neighboring posts and having fastening portions disposed on both end portions thereof;

bending portions each extended from one side surface of each soundproof panel;

soundproof materials each interposed between each fastening portion and each bending portion in such a manner as to be supportedly brought on one surface thereof into contact with one side surface of each post; and a plurality of connection joints each coupled on both ends thereof to the fastening portions disposed on both side surfaces of each post, wherein the post located at the corner portion in the plurality of posts has supports located at the outer surfaces thereof in such a manner as to be supportedly brought into contact with one surface of the soundproof material, and the connection joint coupled on both ends thereof to the fastening portions disposed on both side surfaces of the post located at the corner portion is mounted on the outer surface thereof along the corner portion of the post located at the corner portion, whereas the connection joint coupled on both ends thereof to the fastening portions disposed on both side surfaces of the entire post except the post located at the corner portion is mounted along the outer surface of the entire post except the post located at the corner portion.

2. The soundproof panel connection structure according to claim 1, wherein each soundproof material is made of EPDM (Ethylene Propylene Diene Monomer).

3. The soundproof panel connection structure according to claim 1, wherein the connection joints are spaced apart from each other by a given distance along the direction of the height of the plurality of posts, each connection joint being coupled on both ends thereof to the fastening portions disposed on both side surfaces of each post.

4. The soundproof panel connection structure according to claim 1, wherein so as to install a roof along the top portions of the soundproof panels, a first fastener is coupled to the upper portion of the corner of the post located at the corner portion and a second fastener is coupled to the upper portion of the entire post except the post located at the corner portion.

5. The soundproof panel connection structure according to claim 4, wherein the first fastener is coupled to fastening nuts coupled to both side surfaces of the upper portion of the corner of each post located at the corner portion, and the second fastener is coupled to fastening holes formed on the upper portion of the entire post except the post located at the corner portion.

* * * * *